United States Patent [19]

Doria

[11] 4,164,348

[45] Aug. 14, 1979

[54] JOGGING APPARATUS

[75] Inventor: Joseph J. Doria, Easton, Pa.

[73] Assignee: Harris Corporation, Cleveland, Ohio

[21] Appl. No.: 836,391

[22] Filed: Sep. 26, 1977

[51] Int. Cl.[2] ..... B65H 31/38

[52] U.S. Cl. ..... 271/221; 271/3.1

[58] Field of Search ..... 271/221, 222, 210, 238, 271/3.1; 214/6 S

[56] References Cited

U.S. PATENT DOCUMENTS

| | | | |
|---|---|---|---|
| 853,628 | 5/1907 | Dummer | 271/238 |
| 1,141,277 | 6/1915 | Smith | 271/221 X |
| 2,275,688 | 3/1942 | Schulz | 271/222 |
| 3,690,650 | 9/1972 | Maier et al. | 271/221 X |

*Primary Examiner*—Bruce H. Stoner, Jr.

[57] ABSTRACT

A jogger structure, particularly for automated systems in which sheet material articles such as signatures are fed at high speeds into a vertically extending hopper. A pair of movable support members are interconnected with an actuator member which is operative to alternately move the support members in first and second directions. Each support member has first and second force applying members fixedly connected thereto, and which alternately (1) jog opposite edges of the sheet material articles, and (2) jog one of the remaining edges of the sheet material articles as the support members are moved in the first and second directions. The support members are interconnected with the actuator to move with a "scissors" type action which maximizes movement with a very few relatively movable parts.

10 Claims, 6 Drawing Figures

JOGGING APPARATUS

BACKGROUND OF THE INVENTION

This invention relates generally to apparatus for jogging sheet material articles which are deposited in a hopper. It relates particularly to a jogging apparatus which is suitable for use in high speed signature handling systems in which signatures are automatically fed into the top end of a hopper while signatures are being withdrawn from the bottom end thereof.

In many known types of high speed signature handling systems signatures are automatically fed into the top end of a hopper while signatures are being withdrawn from the bottom end thereof. Such type of systems may be found in disclosures such as U.S. Pat. Nos. 3,674,258 and 3,690,650 and 3,825,246. As explained in U.S. Pat. No. 3,690,650, it is often desirable to jog the signatures as they descend in the hopper, in order to assist their descent, and to help to correctly position the signatures within the hopper. U.S. Pat. No. 3,690,650 discloses two types of apparatus for jogging signatures as they are fed into a hopper.

Other known systems for jogging sheet material articles can be found in disclosures such as U.S. Pat. Nos. 3,593,992, 2,393,254, 1,851,972, 1,949,764, 1,235,477 and 702,966. According to the disclosures of most of these patents, jogging takes place against sheet material articles which are essentially at rest within the hopper and by means of fairly complicated structures having numerous moving parts.

SUMMARY OF THE INVENTION

The present invention provides what is believed to be an improved jogger structure, particularly for automated systems in which sheet material articles such as signatures are fed at high speeds into a vertically extending hopper. According to the invention, a pair of movable support members are interconnected with an actuator member which is operative to alternately move the support members in first and second directions. Each support member has first and second force applying members fixedly connected thereto, and which alternately (1) jog opposite edges of the sheet material articles, and (2) jog one of the remaining edges of the sheet material articles as the support members are moved in the first and second directions. The support members are interconnected with the actuator to move with a "scissors" type action which maximizes movement with a very few relatively movable parts. In fact, through a very few movable parts, three of the four sides of the incoming sheet material articles can be jogged.

According to the preferred embodiment, the support members are mounted for rotational movement about respective fixed parallel axes. The actuator alternately rotates the support members if first (and opposite) directions about their axes and in second (and opposite) directions about their axes. Each support member includes first and second force applying members connected in fixed positional relationship therewith. Both first force applying members are disposed to apply forces to a common edge of sheet material articles during rotation of the support members in first directions about their axes. Both second force applying members are disposed to apply forces to opposite edges of the sheet material articles during rotation of the support members in second directions about their axes.

In the preferred embodiment support members are also supported for rotation about a common axis which is parallel to the fixed axes. The actuator member is interconnected with the common axis for moving the common axis in directions transverse to the fixed axes, thereby rotating both support members about their fixed axes and about the common axis for alternately bringing the first and second force applying member into engagement with the sheet material articles.

BRIEF DESCRIPTION OF THE DRAWINGS

The further features and advantages of this invention will become further apparent from the following detailed description taken with reference to the accompanying drawings wherein.

DETAILED DESCRIPTION OF THE PREFERRED EMBODIMENT

Figure 1:
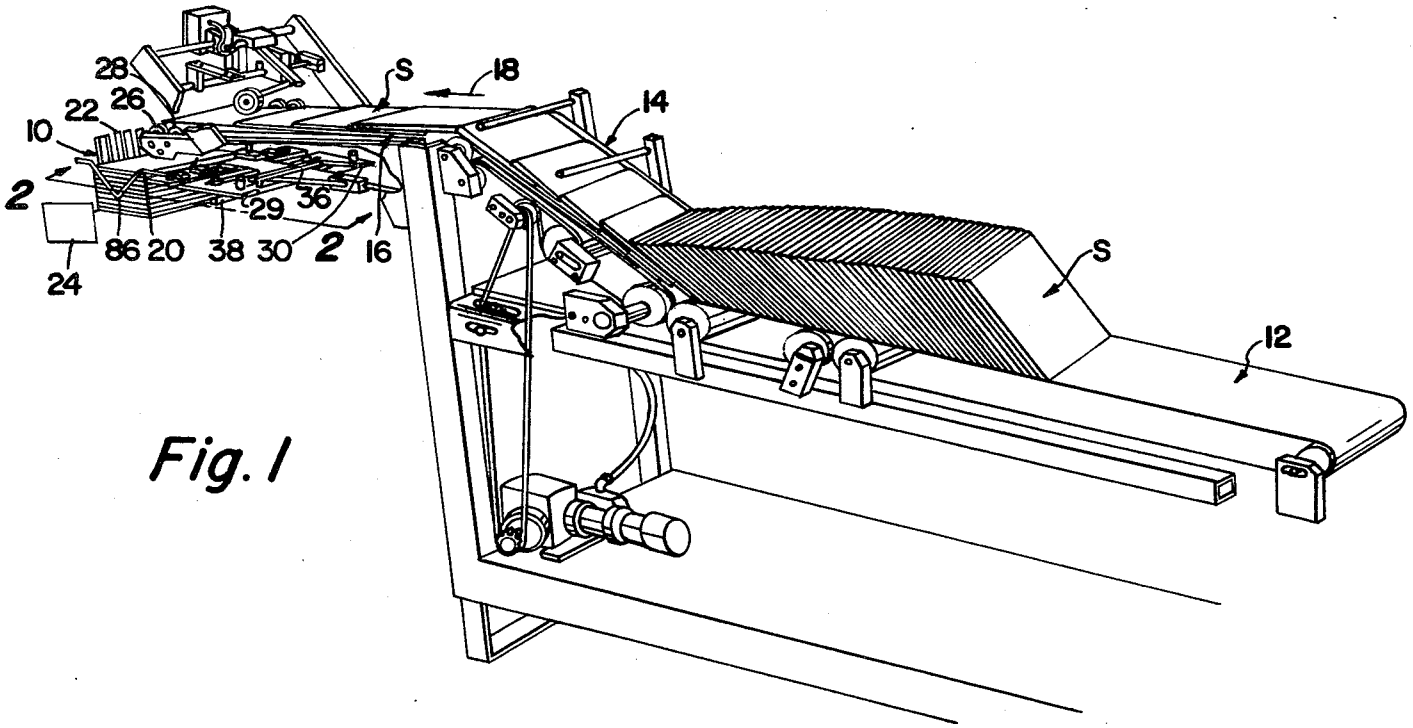
FIG. 1 is a perspective illustration of the hopper loader portion of a signature handling system including a jogging apparatus constructed according to the principles of the present invention.

As noted above, the present invention is particularly suitable for use in connection with an automated high speed signature handling system where signatures are fed into the top end of a vertically extending hopper as signatures are being withdrawn from the bottom end of the hopper. In the sheet handling system illustrated in FIG. 1, signatures S are fed into the top end of a vertically extending hopper 10. The signatures are loaded onto a horizontal conveyor 12 in a generally on-edge condition. Conveyor 12 advances the signature toward an upwardly inclined conveyor 14 which is driven at a faster speed than conveyor 12. The conveyor 14 engages the flat surface of the signatures, and forms the signatures into an overlapped, or shingled stream. The overlapped signatures are then engaged by another conveyor 16 which transports the signatures to the upper end of the hopper 10.

The combination of conveyors 12, 14 and 16 forms a part of what has been known in the art as a "hopper loader ". The foregoing description broadly describes the functions of a hopper loader, since the specific construction of the hopper loader can be by means of structures already known in that art. For example, the hopper loader can include features suggested to the art in disclosures such as U.S. Pat. Nos. 3,881,718, 3,904,191, 3,945,633, or aforementioned U.S. Pat. No. 3,690,650.

The overlapped structures are advanced along horizontal conveyor 16 in the direction of arrow 18, and as they reach the end of conveyor 16 they are deposited into the top end of hopper 10 which is a generally vertically extending hopper. The hopper includes a generally horizontally extending bottom support 20, and a front wall 22 which extends vertically upwardly from the bottom support 20. If desired, the hopper could include backwalls and sidewalls (not shown) which would also extend vertically upwardly from the bottom support 20.

As used herein, term "generally vertically extending hopper" identifies a hopper in which the walls (i.e. front wall, back wall and side walls) extend vertically upwardly from the bottom support at enough of an incline to the horizontal such that sheet or signature articles deposited into the top end of the hopper tend to advance toward the bottom thereof generally under the influence of gravity.

The signatures are withdrawn from the bottom of the hopper, and the hopper loader feeds additional signatures into the top end of the hopper when the stack of signatures in the hopper falls below a predetermined minimum level. In the illustrated system, the signatures are directed to the hopper with their folded edges foremost and, with the help of the jogger of the present invention, the signatures are stacked within the hopper with their folded edges adjacent the front wall 22. Gripper means of known construction (and schematically shown at 24) are disposed adjacent the lower end of front wall 22. The gripper means withdraw the signatures from the bottom of the hoppers, and collator means, also of known construction, associate the withdrawn signatures with other signatures to form a product such as a book or magazine. The withdrawing of signatures from the bottom end of the hoppers depletes the pile until it falls below the predetermined level. The conveyors, 12, 14 and 16 are then energized to continuously feed signatures into the top of the hopper until a predetermined level of the signatures with the hopper is replenished. The conveyors 12, 14 and 16 are de-energized when the predetermined level of signatures is attained.

The flow of signatures into the hopper may be continuous for periods of time, such as by a system as disclosed in U.S. Pat. No. 3,674,258, or the flow of signatures may be in "bursts" such as by a system as disclosed in U.S. Pat. No. 3,690,650. There are also other ways of automatically feeding signatures to a hopper which are known to those of ordinary skill in the art.

As the signatures are fed over a pair of rolls 26, 28 at the downstream end of conveyor 16, they are guided downwardly into the top of the hopper 10. A fixed guide bar 25 disposed above the roller 26, 28 helps to guide the signatures into the hopper. As they enter the hopper, the signatures are jogged by means of the aparatus of the present invention. The jogging of the signatures assists their descent toward the bottom of the hopper, and also helps to properly position the signatures against the front wall 22 of the hopper.

Figure 2:
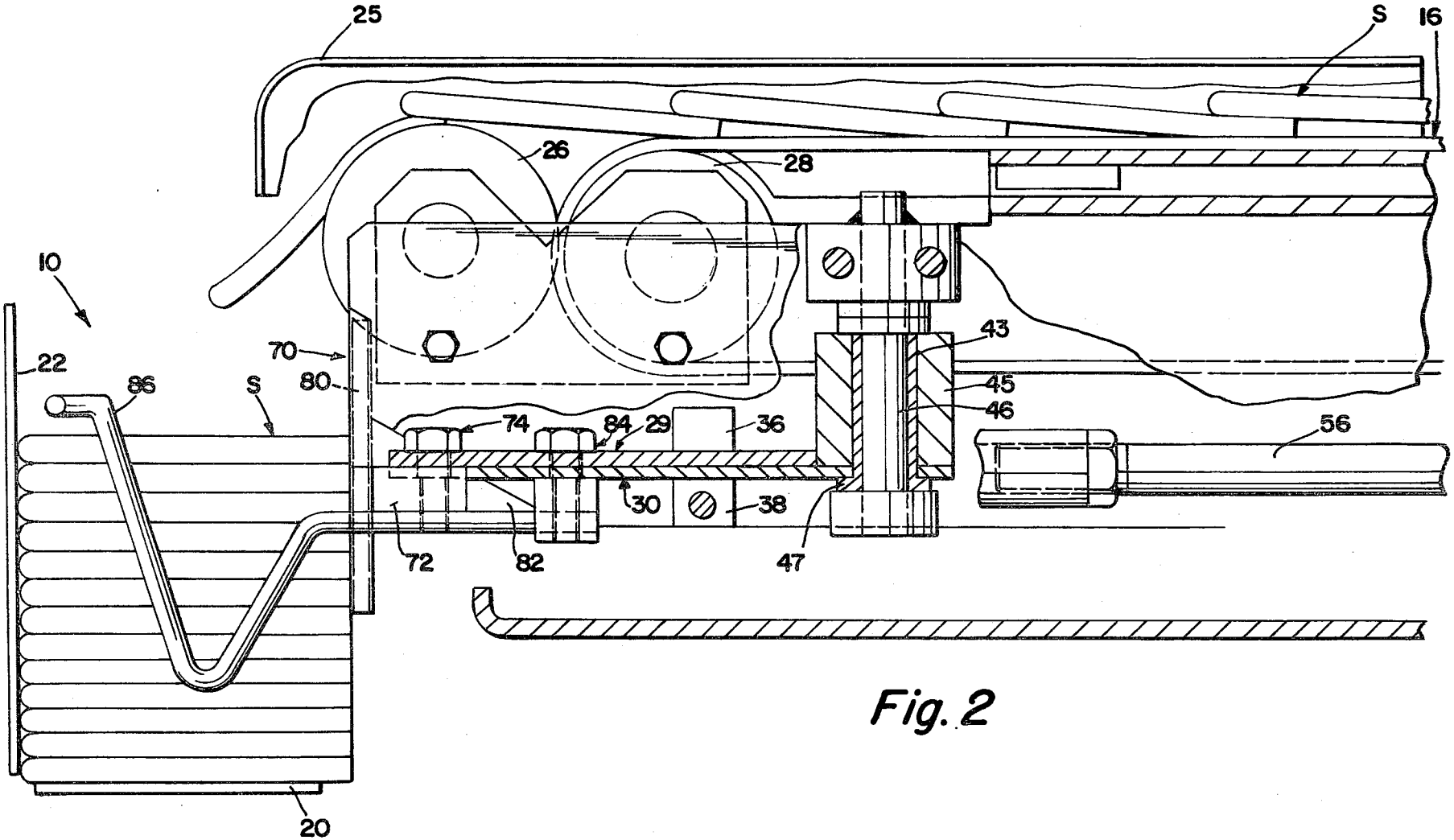
FIG. 2 is a side view of a portion of the jogging apparatus of FIG. 1 taken approximately from the direction 2—2 with certain portions omitted and certain portions shown in section.

The jogging apparatus according to the invention includes a pair of movable support members. In the illustrated embodiment, the support members are formed by juxtaposed plate members 29, 30. Both plate members have respective portions 32, 34 which are disposed between a pair of elongated guide bars 36, 38 which are fixed with respect to the frame of the hopper loader. One end of upper plate member 29 is rotatable about a bushing 40 which is mounted on a shaft 41. Shaft 41 is supported in fixed positional relationship to the frame of the hopper loader. The upper plate 29 is therefore freely rotatable in both directions about the fixed central axis 42 of the bushing 40. The lower plate 30 is also freely rotatable about the axis 44 of another bushing 43 which is mounted on a shaft 46 supported in fixed positional relationship to the frame of the hopper loader. A collar (such as 45 in FIG. 2) journals each bushing and maintains the associated plate against a bottom flange 47 of the bushing. The bushings 40, 43 are spaced from, and parallel to each other. Both plates are therefore rotatable about parallel axes 42, 44 which are fixed with respect to the frame of the hopper loader.

Figure 3:
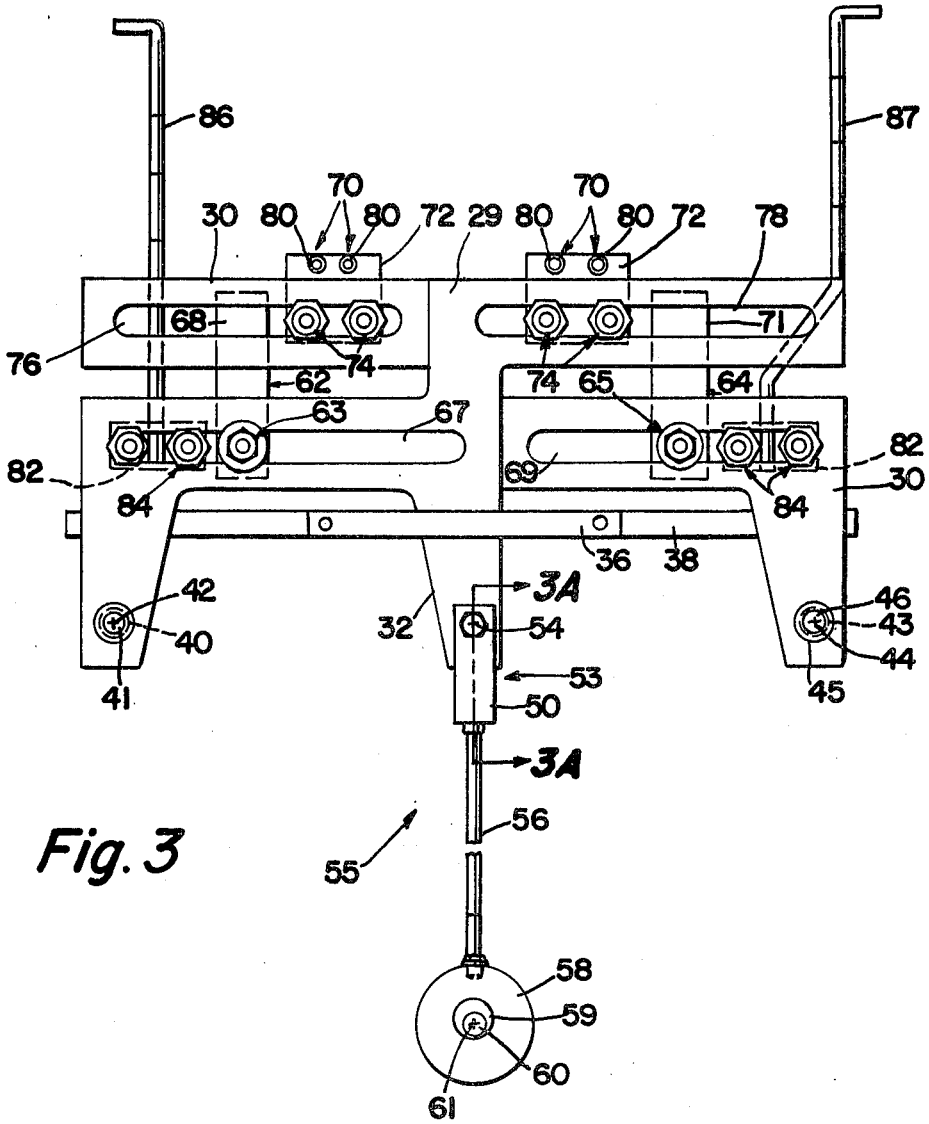
FIG. 3 is a top view of a jogging apparatus constructed according to the principles of this invention, and in an inoperative condition.
Figure 3A:
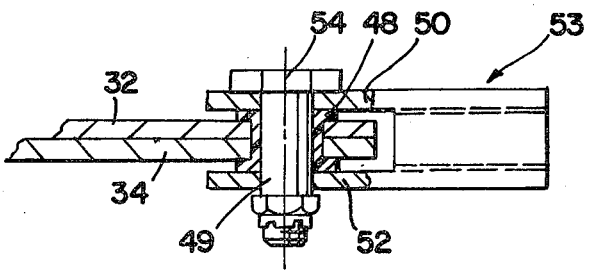
FIG. 3A is a sectional view of the jogging apparatus of FIG. 3, taken approximately from the direction 3A—3A.

As seen in FIG. 3A, the portions 32, 34 of the upper and lower plates which extend between the guide bars 36, 38 are both freely rotatable about a collar 48 which surrounds a shaft 49. Shaft 49 is supported between a pair of arms 50, 52 of a bracket 53. Both plates 29, 30 are therefore freely rotatable about the central axis 54 of the collar 48. The central axis 54 of bushing 48 is disposed parallel to fixed axes 42, 44.

Bracket 53 forms part of an actuator member 55 which moves the shaft 49 transverse to the fixed axes 42, 44 to rotate both plate members about the axes 42, 44. Bracket 53 is fixedly connected to one end of a longitudinally extending rod 56. The opposite end of rod 56 is connected to a housing member 58 which journals an eccentric portion 59 of a rotatable shaft 60. Shaft 60 is supported for rotation about an axis 61 which is parallel to the fixed axes 42, 44, and the axis 54. Rotation of the shaft 60 oscillates the actuator member 53 and moves the shaft 49 in directions transverse to the fixed axes 42, 44.

As the shaft 60 rotates, the eccentric portion 59 alternately moves the actuator member toward and away from the front wall of the hopper. The shaft 60 is rotated by a motor (not shown) of known construction.

A pair of stabilizing bars 62, 64 help to guide the plate members for generally horizontal movement. One stabilizer bar 62 is releasably fixed to the top plate 29 by a lock nut and cap screw assembly 63 which extends through a longitudinal slot 67 in the top plate. The stabilizer bar 62 includes a portion 68 extending below the bottom plate. The other stabilizer 64 is releasably fixed to the bottom plate by a lock nut and cap screw assembly 65 which extends through a longitudinal slot 69 in the bottom plate 30. The stabilizer bar 64 includes a portion 71 extending beneath the top plate.

First force applying members 70 are releasably fixed to each of the upper and lower plate members. A block 72 is disposed beneath each of the plate members, and is releasably fixed to the respective plate through lock nut and cap screw assemblies 74 which extend through longitudinal slots 76, 78 in the respective plates. The first force applying members 70 are formed by pairs of vertical rods 80 extending through vertical holes in the blocks 72. A releasble locking member (not shown) fixes each rod 80 to the respective block 72, and also allows adjustment of the vertical position of the rod. The releasable locking nut and cap screw assemblies 74 fix rods 80 to the respective plates, and also allows transverse adjustment of the position of the block and rods relative to the respective plates.

Second forces applying members are also releasably fixed to each plate member. The second forces applying members are supported on block members 82 which are releasably fixed to the respective plate members by means of locking nut and cap screw assemblies 84 which extend through slots 67, 69 in the plate members. The second force applying members are formed by rod members 86, 87 each of which extends through a hole in a respective block and which is releasably fixed thereto (by means not shown). While the specific configurations of the rod members 86, 87 may vary, each rod member includes a portion extending toward the front wall 22 of the hopper, and a vertically extending portion.

Figure 4:
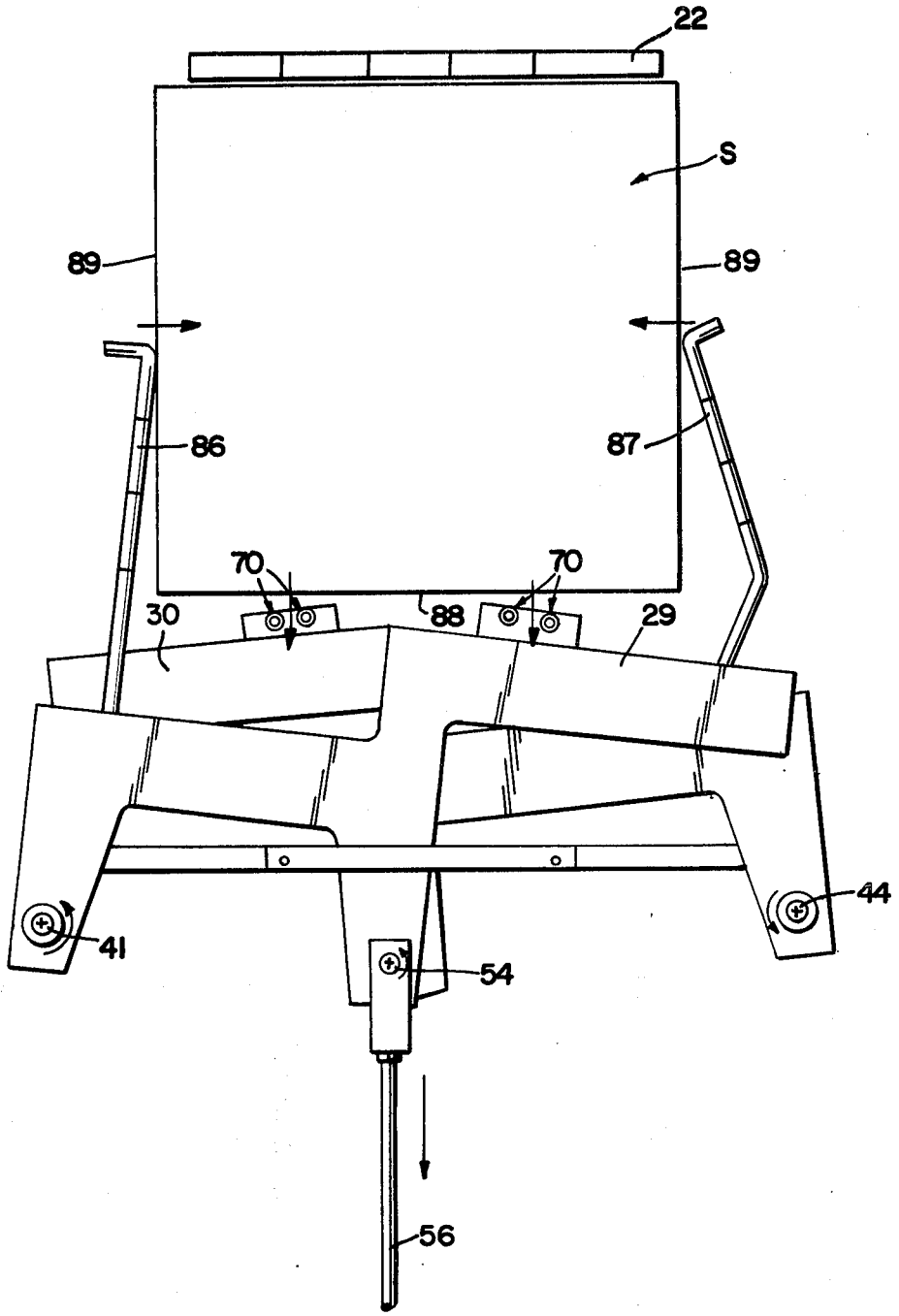
FIGS. 4 and 5 are schematic top views of the jogging apparatus of the present invention illustrating selected jogging positions.
Figure 5:
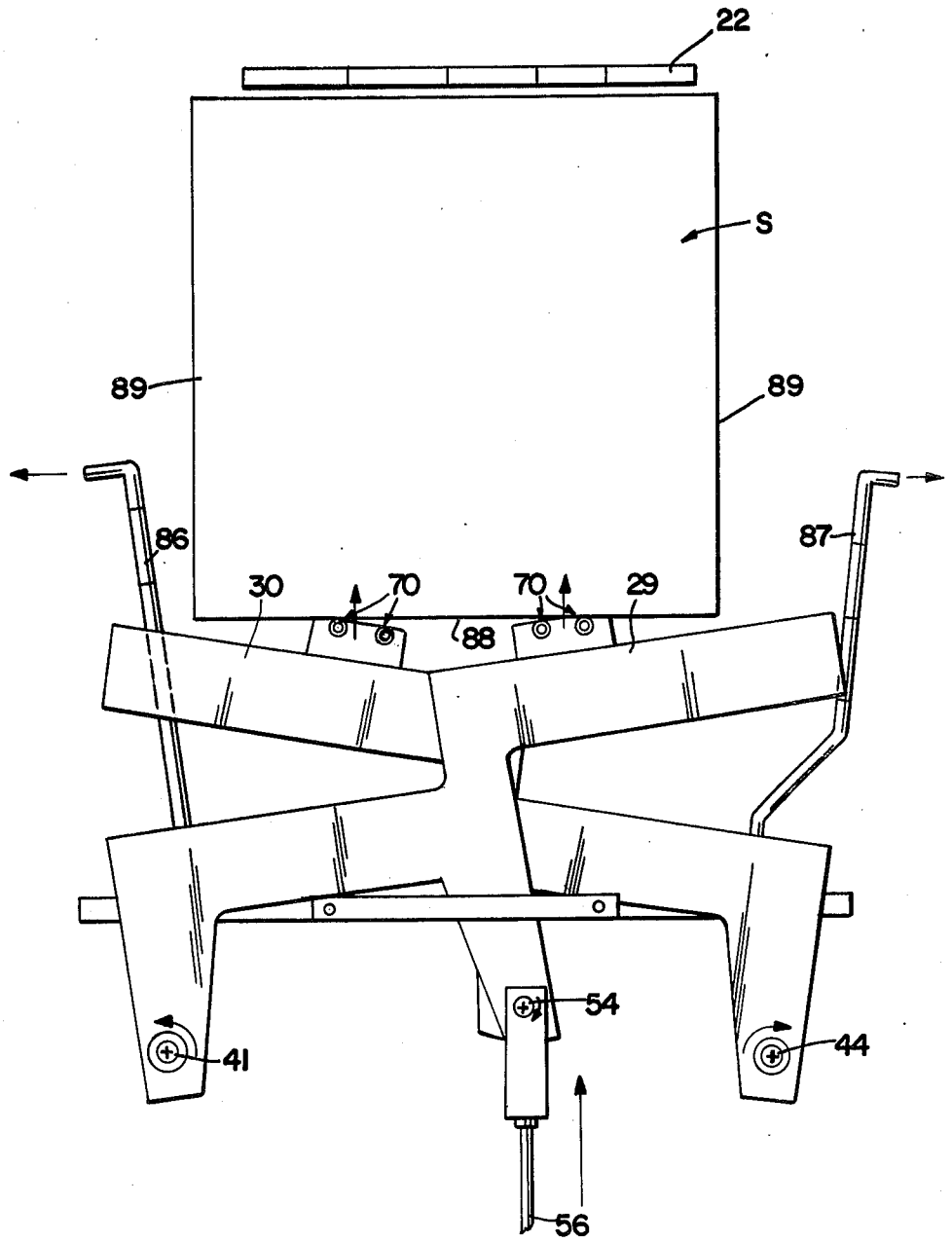

As the actuating rod 56 is oscillated due to rotation of the shaft 60 the plate members move with a "scissors" type action as shown in FIGS. 4 and 5. As seen in FIG. 5, when the rod moves toward the front wall 22 of the hopper the plate members are rotated in opposite directions about their fixed axes 42, 44 and about their common axis 54. The rods 72 are moved toward a common edge 88 of the incoming signatures and inpart a force there against. The second force applying rods 86, 87 are simulatneously moved outwardly and away from the opposite side edges 89 of the signatures being fed to the hopper.

As seen in FIG. 4, as rod 56 is moved away from the front wall 22 of the hopper the plates are rotated in opposite directions about their respective fixed axes 42, 44 and about their common axis 54. This moves the second force applying rods 86, 87 toward opposite sides 89 of the signatures to impart forces thereto. During such movement, the rods 72 are moved away from the common edge 88 of the signatures. The shaft 60 is continuously rotated during periods that the signatures are being fed to the hopper so that the first and second force applying members alternately impart their respective forces to signatures as they are delivered to the top of the hopper.

In view of the foregoing disclosure, it will be recognized by those of ordinary skill in the art that various obvious modifications of the specific structure described above can be made without departing from the spirit of the present invention.

What is claime is:

1. In a sheet handling system of the type in which sheet material articles are deposited in the upper end of a hopper and descend toward the bottom end thereof under the influence of gravity, apparatus for jogging the sheet material articles as the sheet material articles descend, said apparatus comprising first and second support members, means for mounting said first and second support members for rotational movement about respective first and second parallel axes, a moveable actuator member, means interconnecting said actuator member with said first and second support member for rotating said first support member in a first rotational direction about said first axis and for rotating said second support member in a direction opposite to said first rotational direction about said second axis in response to a first mode of movement of said actuator member and for rotating said first support member in a second rotational direction about said first axis and for rotating said second support member in a direction opposite to said second rotational direction about said second axis in response to a second mode of movement of said actuator member, means for driving said actuator member alternately in its first and second modes of movement, first and second force applying members fixedly connected with each of said first and second support members, said first force applying members being disposed for movement toward opposite side edges of sheet material articles in said hopper for applying forces to the opposite side edges of sheet material articles in said hopper during movement of said first and second support members in response to said first mode of movement of said actuator member, and said second force applying members being disposed for movement toward a common edge of the sheet material articles in the hopper for applying forces to the common edge of the sheet material articles in the hopper during movement of said first and second support members in response to said second mode of movement of said actuator member.

2. In a sheet handling system as set forth in claim 1 wherein said first and second axes are fixed and each of said first and said second support members in pivotally supported for rotation about a third axis which is parallel to said first and second axes, said actuator member being connected with said third axis, and said drive means being adapted to move said actuator member and said third axis in directions transverse to said first and second axes as it moves said actuator member in said first and second modes of movement.

3. In a sheet handling system of the type set forth by claim 1 including means for adjusting the fixed positional relationship of the first and second force applying members relative to their repsective first and second support members.

4. In a sheet handling system of the type set forth by claim 1 wherein said first and second support members comprise juxtaposed horizontally extending first and second plate members, said first force applying members including vertically extending rod members connected with each of said first and second plate members, said second force applying members including vertically extending rod members connected with each of said first and second plate members.

5. In a sheet handling system of the type set forth by claim 4 wherein said first and second axes are fixed, said first and second plate members being rotatable about a common axis which is parallel to said first and second axes, said actuator member comprising an elongated rod member having a first portion connected with said common axis and extending transverse thereto, a second portion of said rod member connected with a housing member, said drive means including a drive shaft rotatable about an axis extending parallel to said first and second axes and said common axis, said drive shaft including an eccentric portion journaled in said housing member for oscillating said housing member and said rod member and thereby said common axis in direction transverse to said fixed axes in response to rotation of said shaft.

6. In a sheet handling system of the type including conveyor means for feeding sheet material articles into the top end of a vertically extending hopper and where sheet material articles are withdrawn from the bottom end thereof, apparatus for jogging the sheet material articles being fed to the hopper, said apparatus comprising a first movable support member, a second movable support member, an actuator member interconnected with said first and second support members to move said first and second support members in first directions and then in second directions, each of said first and second support members having first and second force applying members fixedly connected thereto for engaging the sheet material articles, said first force applying members being disposed for movement toward opposite side edges of the sheet material articles in response to movement of said first and second support members in said first directions and for movement away from the opposite side edges of the sheet material articles in response to movement of said first and second support members in said second directions, said second force applying members being disposed for movement toward a common edge of the sheet material articles in response to movement of said first and second support members in said second directions and for movement away from the common edge of the sheet material articles in response to movememt of said first and second support members in said first directions.

7. In a sheet handling system as defined in claim 6 wherein said first support member is rotatable about a first fixed axis and said second support member is rotatable about a second fixed axis which is parallel to said first axis, said actuator being interconnected with said first and second support members for alternately rotating said first and second support members in first opposing directions about said first and second axes and for rotating said first and second support members in second opposing directions about said first and second axes.

8. In a sheet handling system as defined in claim 6 wherein said first and second support members are rotatable in opposite directions about a common axis, said actuator being interconnected with said first and second support members for alternately rotating said first and second support members in first opposing directions about said common axis and for rotating said first and second support members in second opposing directions about said common axis.

9. In a sheeting handling system as defined in claim 8 wherein each of said first and second support members is freely rotatable about said common axis, said first support member being further rotatable about a first fixed axis and said second support member being further rotatable about a second fixed axis, said first and second axes being parallel to said common axis, said actuator being interconnected with said common axis for moving said common axis transverse to said first and second fixed axes for rotating said first and second support members about said common axis and about said first and second axes.

10. In a sheet handling system of the type in which sheet material articles are deposited in a hopper, apparatus for jogging the sheet material articles in the hopper, said apparatus comprising a pair of first jogger members for engaging respective opposite sides of the sheet material articles, a pair of second jogger members for engaging a third side of the sheet material articles which extends between the first and second sides, a first movable support member, means for fixedly securing one of said first jogger members and one of said second jogger members to said first movable support member for movement therewith, a second movable support member, means for fixedly securing the other of said first jogger members and the other of said second jogger members to said second movable support member for movement therewith, means supporting said first and second support members for simultaneous movement in first directions to effect engagement of the said first jogger members with the respective opposite sides of said articles and in opposite second directions to move said first jogger members away from said respective opposite sides while effecting movement of said second jogger members into engagement with said third side of said sheet material articles, and an actuator member connected to said first and second support members to effect said movement of said first and second support members in said first directions and then in said second directions.

* * * * *